US005259442A

United States Patent [19]

Clark

[11] Patent Number: 5,259,442

[45] Date of Patent: Nov. 9, 1993

[54] METHOD OF ADDING ALLOYING MATERIALS AND METALLURGICAL ADDITIVES TO INGOTS AND COMPOSITE INGOT

[75] Inventor: James H. Clark, Windsor, Pa.

[73] Assignee: Specialty Metallurgical Products, Windsor, Pa.

[21] Appl. No.: 912,994

[22] Filed: Jul. 14, 1992

[51] Int. Cl.[5] ..... B22D 19/00; B22D 27/20

[52] U.S. Cl. ..... 164/461; 164/47; 164/57.1; 164/98

[58] Field of Search ..... 164/461, 97, 57.1, 58.1, 164/47

[56] References Cited

U.S. PATENT DOCUMENTS

| | | | |
|---|---|---|---|
| 3,604,494 | 9/1971 | Trager | 164/97 |
| 3,862,657 | 1/1975 | Thalmann | 164/461 |
| 3,871,058 | 3/1975 | Wallace | 164/97 |
| 4,567,936 | 2/1986 | Binczewski | 164/453 |
| 4,708,847 | 11/1987 | Donomoto et al. | 420/129 |
| 4,759,995 | 7/1988 | Skibo et al. | 428/614 |
| 4,919,187 | 4/1990 | Rupp et al. | 164/57.1 |
| 5,030,519 | 7/1991 | Scruggs et al. | 428/614 |

FOREIGN PATENT DOCUMENTS

| | | | |
|---|---|---|---|
| 57-43952 | 3/1982 | Japan | 164/97 |
| 57-195562 | 12/1982 | Japan | 164/461 |

*Primary Examiner*—Kuang Y. Lin
*Attorney, Agent, or Firm*—Thomas Hooker

[57] ABSTRACT

Metal ingots are mold cast at a smelter with a solid, unmelted alloy or metallurgical additive body placed in the mold so that the molten metal in the ingot solidifies around the body. The metal and body in the ingot are melted at a foundry to freshly distribute the melted alloy or metallurgical additive material in the body throughout the remelted ingot metal immediately before casting useful articles from the melted ingot.

28 Claims, 1 Drawing Sheet

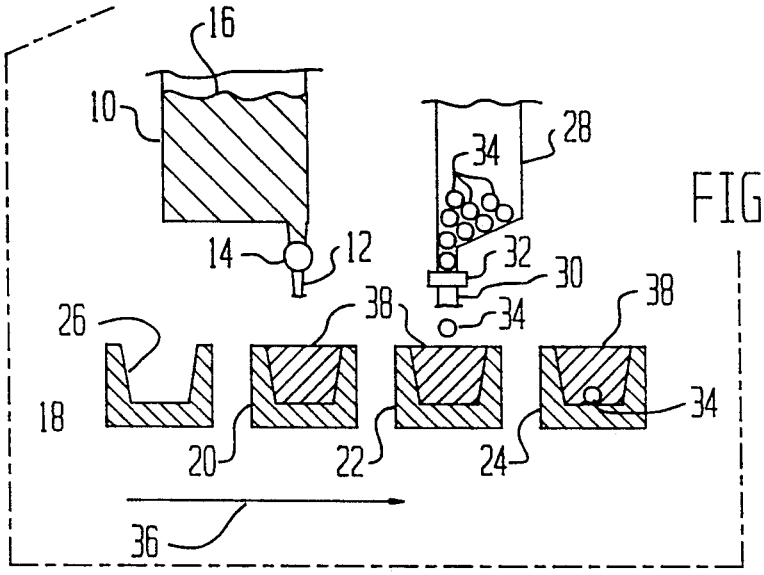
FIG. 1
FIG. 2
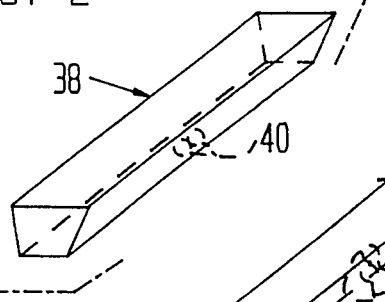
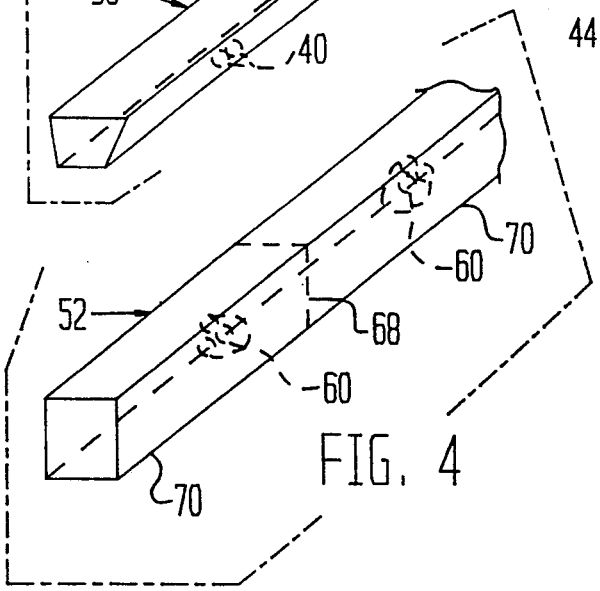
FIG. 4
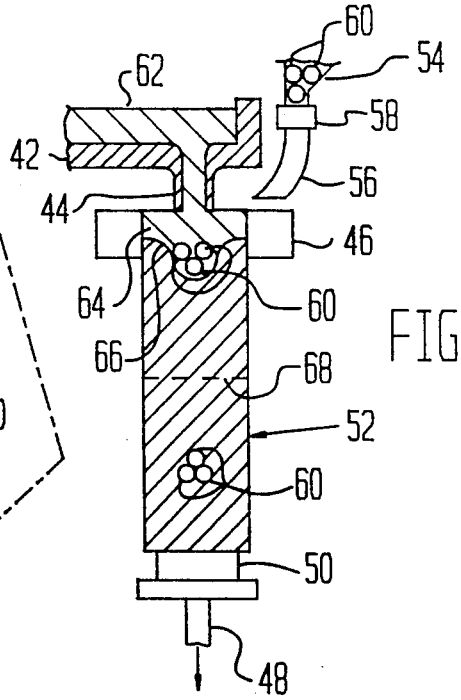
FIG 3

METHOD OF ADDING ALLOYING MATERIALS AND METALLURGICAL ADDITIVES TO INGOTS AND COMPOSITE INGOT

FIELD OF THE INVENTION

The invention relates to the addition of metallurgical additives or alloying elements to metals during casting of ingots which are subsequently melted and recast into useful articles. The invention is particularly useful in the casting of aluminum ingots which are subsequently melted for recasting.

DESCRIPTION OF THE PRIOR ART

Cast metal parts are conventionally made at a foundry by melting metal ingots to form a relative large volume molten melt and then pouring off molten metal to fill individual molds as required. The chemical composition of the melt is conventionally determined by the chemical composition of the metal in the ingots. Normally, alloying materials and metallurgical additives are not added to the molten foundry metal.

The ingots melted at a foundry are conventionally poured at either a primary or secondary smelter from a large melt held in a holding furnace at a relatively high temperature. The metal in the melt may be refined directly from an ore or may be recycled metal made by melting down scrap materials, with or without the addition of virgin metal.

Alloying elements are added to large molten melts held in smelter holding furnaces in order to give the metal desired metallurgical properties of recognized alloys. Metallurgical additives are added to and dissolve in the melt. These relatively large metal melts with added alloying agents and metallurgical additives are cast to form relatively homogeneous ingots with each ingot including alloying elements and metallurgical additives distributed throughout the metal in the ingot. The metallurgical additives enhance the mechanical and physical properties of the alloy.

Molten aluminum is alloyed at the smelter by the addition of alloying elements including chrome, copper, iron, magnesium, mangenese, nickel, silicon, tin, and zinc. These alloying elements are added to the molten melt to make a casting alloy. Metallurgical additives are also added to the melt and dissolved in the melt at this time. These additives include antimony, beryllium, boron, calcium, fluxing salts, phosphorous, silver, sodium, strontium, titanium, titanium boron, vanadium, zirconium, and other elements and compounds of elements. Metallurgical additives may also be added to alloys. Titanium-based metallurgical additives added to molten aluminum are discussed in Snow U.S. Pat. No. 3,854,935, the disclosure of which is incorporated herein by reference. Metallurgical additives are conventionally added to molten aluminum in relatively small briquets, pellets or tablets which melt in the hot metal bath.

After alloying agents and metallurgical additives have been dissolved in the large molten melts of aluminum maintained at the smelter, the melt is poured off into individual molds to form aluminum ingots which are cooled, packaged and subsequently shipped to foundries for remelting and casting to form useful articles. While the amount of alloying agent and metallurgical additives added to the original aluminum melt is calculated to form a particular aluminum alloy with particular desired additive properties, in practice, the concentration of alloying materials and metallurgical additives in the individual ingots varies for a variety of reasons. There is no way to assure that the metal in a particular ingot has the proper concentration of alloy or the proper concentration of metallurgical additives.

One of the problems assuring uniform alloy and metallurgical additive content of the ingot arises because of furnace contamination. It is very difficult to remove all of the metal of a previous melt from the holding furnace while building a new melt. Residual metal contaminates the new melt. Additionally, it is difficult to assure that the alloying agents and metallurgical additives are uniformly distributed throughout the volume of a melt during the relatively long period required to build the melt and then pour off the individual ingots from the melt. The problem of properly alloying the melt is exacerbated when the melt includes a sizeable amount of recycled aluminum which includes alloy previously added to the recycled aluminum. The determination of the concentration and amount of this alloy is very difficult and, in some cases, impossible.

The effectiveness of metallurgical additives dissolved in a melt of molten aluminum wanes with the passage of time. This degradation of the metallurgical additive results in a degraded effective concentration of metallurgical additive in the remelted aluminum bath at the foundry from which the articles are cast.

The smelter-cast ingots are given particular alloy identifications and metallurgical additives identifications in accordance with the alloys and additive concentrations believed to be in the ingots as cast at the smelter, independent of whether or not the identified alloy and additive compositions of a particular ingot are correct. Changes in actual alloy concentration and additive concentration arising from the problems identified above make it difficult for the foundryman to be sure that the aluminum melt formed by remelting the cast ingots possesses the indicated alloy and additive concentration. In practice, there may be wide variations in these concentrations within a group of individual ingots, which are marketed as having particular alloy and additive concentrations. Typically, the alloy concentration may be greater or less than indicated and the additive concentration is less than indicated.

Some smelter operations now add alloying elements to molten metal by moving an alloy wire into the stream of molten metal which is poured from a bath into a mold. The alloying wire is melted in the poured metal and distributed throughout metal in the ingot mold. This method of adding alloying elements to cast ingots improves the uniform alloy concentration in the remelt bath formed from melted ingots. When used, the problem of assuring uniform and fresh concentration of metallurgical additives in the remelt bath remains.

SUMMARY OF THE INVENTION

The invention relates to the method of assuring proper alloy or metallurgical additive concentration in cast ingots which are subsequently melted and recast into useful articles, to the method of casting useful articles with proper alloy or metallurgical additive concentration and to composite ingots. The alloying materials or additives are placed in the ingot mold or in the direct chill cast ingot during casting as separate, discreet bodies and are captured, unmelted, within the ingot when the cast molten metal solidifies. The ingots may be pour-cast using conventional ingot molds or may be direct chill cast to form an ingot billet which is subsequently cut into individual ingots.

The alloys or metallurgical additives are added to the molds in proper concentration for the amount of metal in the ingot. When the ingot is remelted at the foundry, the melt is raised to a sufficiently high temperature to melt the bodies and release the desired concentration of alloying material or metallurgical additives a short time prior to casting. Proper concentration is assured. There is insufficient time between the melting of the additives and casting for the additives to wane or lose their effectiveness due to oxidation or other factors so that the cast articles have the desired alloy and metallurgical additive concentration.

As previously described, the invention contemplates placing solid bodies of alloying materials and/or metallurgical additives in the smelter-poured ingots and solidifying the ingots around these bodies without melting the bodies. The bodies are first melted when the ingots are remelted at the foundry prior to pouring. The invention may also be used in connection with adding either alloy bodies or metallurgical additive bodies to the cast ingots one without the other. The following detailed description of the invention describes the invention with regard to adding metallurgical additive bodies to the ingot molds. Obviously, alloy bodies may be added to the ingots, or alloy and metallurgical additive bodies both may be added to the ingots, as desired.

Other objects and features of the invention will become apparent as the description proceeds, especially when taken in conjunction with the accompanying drawings illustrating the invention, of which there are one sheet and two embodiments.

DESCRIPTION OF THE DRAWINGS

FIG. 1 is a representational view illustrating pour casting of metal ingots and adding metallurgical additives;

FIG. 2 is perspective view of an ingot pour cast according to FIG. 1;

FIG. 3 is a sectional view illustrating direct cooling casting of ingots and adding metallurgical additives; and FIG. 4 is a perspective view of a DC cast ingot according to FIG. 3.

DESCRIPTION OF THE PREFERRED EMBODIMENTS

The invention will be described in connection with the casting of aluminum ingots, either mold cast or direct chill ("DC") cast with captured solid and unmelted bodies of metallurgical additives in the ingots. Sufficient solid additives are cast in the ingots to provide the required fresh concentration of additives for all of the aluminum in the ingots when the ingots are remelted for casting into useful articles. While the description of the embodiments is made in connection with the casting of aluminum ingots with captured, solid metallurgical additive bodies in the ingots, the invention may be used in casting ingots of other metals with captured additive or alloy solids in the ingots so that upon remelting of the ingots the solids are melted and distributed throughout the metal at a proper and fresh dosage.

As shown in FIG. 1, molten metal holding furnace tank 10 includes a discharge pipe 12 and a valve 14 in the pipe which controls the flow of the molten aluminum bath 16 in the tank through the pipe and into ingot molds located beneath the pipe. The tank may be part of either a primary or secondary smelting operation. In the case of a primary smelting operation, pure molten aluminum refined from bauxite is flowed into the tank. Suitable alloying elements are added to the molten aluminum to make the desired aluminum alloy to be poured.

In a secondary smelter, tank 10 is filled with a bath of molten aluminum smelted from aluminum scrap which may or may not be partially blended with pure aluminum. Suitable alloying elements are added to the molten aluminum bath in the tank to supplement the alloys in the remelted aluminum in an attempt to properly alloy the aluminum.

A plurality of open ingot molds 18, 20, 22, and 24 are positioned on a conveyor (not illustrated) below tank 12. Each mold 18–24 includes an elongate trapezoidal cross section mold cavity 26.

A metallurgical additive hopper 28 is located to the right of tank 20 and includes a discharge mouth 30 located above mold 22. Gate 32 at the bottom of the hopper 28 discharges an appropriate number of metallurgical additive bodies 34 held in the hopper 28 into the mold beneath the mouth as required. The conveyor supporting the molds 18–24 moves the molds in the direction of arrow 36 so that each mold is moved through positions shown in FIG. 1.

The conveyor moves an empty mold beneath the discharge pipe of the holding tank 10 following which valve 14 is actuated to permit a volume of molten aluminum 38 to flow from the bath 16 to fill the mold cavity as illustrated. Further downstream movement of the conveyor moves the mold and molten aluminum body 38 to a position beneath hopper 28 at which time gate 32 is actuated to dispense an appropriate number of metallurgical additive bodies 34 from discharge mouth 30 so that the bodies fall down into the molten aluminum body 38. These bodies preferably have a greater density than the density of the molten aluminum and sink to the bottom of the aluminum as shown in mold 24. FIG. 1 illustrates discharge of a single body 34 into the molten aluminum in the mold. An appropriate number of bodies may be dispensed into the aluminum as required.

After placing the appropriate number of metallurgical additive bodies within the molten aluminum in the molds, the mold is moved further to the right to allow the aluminum to cool and solidify prior to ejecting the trapezoidal shaped mold-cast ingot from the mold and returning the mold to the upstream end of the conveyor for subsequent refilling, inoculation with the appropriate number of metallurgical additive bodies, chilling and unmolding.

The pouring temperature of the molten aluminum 16 into the molds, typically 1,200 to 1,850 degrees Fahrenheit, is less than the melting temperature of the main constituents of metallurgical additive bodies 34 so that the dense, solid bodies fall to the bottom of the mold are surrounded by the molten aluminum and are captured in the surrounding molten aluminum, undissolved, as the aluminum chills and solidifies. Low melt temperature constituents of bodies 34 may melt in the aluminum during chilling, particularly those located at the surface of the bodies.

The molten aluminum in the molds surrounds the bodies 34 and captures the bodies within the ingot thereby assuring an appropriate amount of metallurgical additive is associated with the ingot and is freshly available on remelting of the ingot and of the body or bodies to provide the concentrations of metallurgical additive required to assure desired additive properties upon cooling of useful aluminum bodies cast from the aluminum formed by remelting one or more inoculated ingots.

FIG. 1 illustrates casting composite integral aluminum ingots with a single metallurgical additive body 34 captured within the ingot. The ingot may be inoculated with one, two, or more bodies as required to provide the proper metallurgical additive concentration when furnace remelted prior to casting. FIG. 2 is a perspective view of a cast aluminum ingot 38 cast as shown in FIG. 1 with a pair of metallurgical additive bodies 40 captured within the ingot at the lower minor trapezoidal surface defined by the bottom of a mold 18-24.

Inoculated ingots 38 with captured metallurgical bodies are shipped from the smelter where cast to a foundry where an appropriate number of ingots are heated in a remelt furnace at a temperature sufficiently high to melt both the aluminum and the metallurgical additive bodies within the ingots. Upon melting of the bodies, the additive material is distributed uniformly throughout the aluminum within the remelt furnace to form the desired fresh uniform concentration in the molten aluminum. The aluminum in the remelt furnace is cast to form useful articles relatively promptly after melting in order to avoid metallurgical additive fading due to oxidation, volatilization or fluxing problems. The founder no longer needs to be concerned whether there is sufficient, or even too much, metallurgical additive in the ingots which are melted for casting.

In FIG. 1, the metallurgical additive bodies 34 may obviously be placed within open mold 18 prior to filling the mold with molten aluminum 38, if desired. Additionally, the concentration or type of metallurgical additive bodies placed in the molten aluminum ingots may be easily changed without the necessity of emptying and cleaning furnace 10. It is a simple matter to alter the number of bodies placed in the molds or the types of bodies added to the aluminum in the ingot molds.

FIG. 1 illustrates pour casting of relatively small aluminum alloy ingots, typically, weighing 30 to 50 pounds each. These ingots have a tapered trapezoidal shape in cross-section, are approximately 30 inches long and 5-6 inches wide at the top of the ingot.

In some operations it is desirable to mold cast large aluminum ingots or sows which are typically square, about 30-inches long on a side and 1½ feet high. Sows weigh from 500 to 3,000 pounds each. Sows are cast in molds in essentially the same way ingots are cast as in FIG. 1 with the exception that the molds are considerably larger. A sufficient number of the proper type of metallurgical additive bodies are added to the molten aluminum in the sow molds prior to chilling in the same way as described in connection with FIGS. 1 and 2.

FIG. 3 illustrates continuous casting of an elongate ingot body using a direct chill (DC) casting machine. The machine includes a molten aluminum transfer trough 32 extending from a holding tank filled with properly alloyed molten aluminum to a discharge pipe 44 on the bottom of one end of the trough. The lower end of pipe 44 is slightly below the top of a rectangular water-cooled mold 46. Ram 48 is located under the mold 46 and supports a bottom block 50 which, in turn, supports an elongate continuously cast aluminum ingot billet 52. Hopper 54 located adjacent the end of trough 42 includes a discharge mouth 46 located above the rectangular interior of mold 46 and a gate 58 which may be operated to allow an appropriate number of metallurgical additive bodies 60 in the hopper to fall into the mold.

The direct chill casting machine operates in a conventional manner with molten aluminum 62 flowing through trough 48 and down through pipe 44 into a molten aluminum body 64 located in the top of the interior of mold 46. As molten aluminum flows into body 64 cooling water circulates through mold 46 to solidify the aluminum. Ram 48 is lowered thereby moving the solidified aluminum down from the mold while retaining the body 64 of molten aluminum in the upper portion of the interior of the mold. The aluminum immediately adjacent the square interior sidewalls of the mold 46 is cooled and solidifies before the aluminum in the center of the mold to define a central deep point or valley 66 with the molten aluminum in the deep point surrounded by solidified aluminum. This shape of the pool assures that the dense metallurgical bodies 60 discharged into the molten aluminum 64 fall into and are captured in the center of the ingot billet 52.

The appropriate number of metallurgical bodies are dispensed from hopper 54 into the ingot billet 52 to provide the desired metallurgical additive concentration when the DC cast ingots are remelted. An indefinite length of billet 52 is continuously cast using the direct chill (DC) method as described. Following casting the pellet is cut at transverse lines 68 to form separate ingots 70 indicated in FIG. 4. Metallurgical additive bodies 60 sufficient for each ingot are dispensed into the molten aluminum in the ingot at locations away from the cut lines 68, thereby assuring that an appropriate number of bodies 60 are captured in each subsequently formed ingot. In FIGS. 3 and 4, three bodies 60 are cast into each ingot.

As previously described, the metallurgical bodies 60 preferably have a specific gravity greater than the specific gravity of aluminum and, accordingly, sink to the bottom of the valley 66 and are captured in the aluminum in the valley as the aluminum solidifies with retraction of ram 48.

The ingots 70 are transported from the smelter to a foundry where they are placed in a remelt furnace, and are then heated to the temperature sufficiently high to melt both the aluminum and the metallurgical additive bodies captured within the ingots. Upon melting of the bodies, the additives are freshly distributed uniformly within the molten aluminum bath at the desired concentration for the subsequent casting, as previously described, so that the aluminum casting have a proper additive concentration.

FIGS. 3 and 4 illustrate direct chill casting of rectangular cross-section ingots 70. The cross sectional shape of the ingots is defined by the shape of the interior of mold 46 and is not critical to the present invention Billet 52 and ingots 70 cut from the billet may have rectangular, square, circular or other cross-sectional shapes as required.

The term "ingot" as used herein is intended to include both mold-cast ingots as shown FIGS. 1 and 2 of the drawing, sows and direct chill (DC) cast ingots as shown in connection with FIGS. 3 and 4 of the drawing, together with other bodies cast from molten metal with captured metallurgical bodies formed from alloying agents, metallurgical additives or other ingredients intended to be freshly distributed throughout the metal body upon remelting prior to casting.

While the invention has been described in connection with the addition of solid, unmelted metallurgical additive bodies to molten aluminum with the specific gravity of the bodies being greater than that of the aluminum, variations of the invention are contemplated. For instance, in some applications it may be desirable to add conventional alloying elements to unalloyed or partially alloyed molten aluminum in ingot molds in order to form a solidified ingot with inoculated or captured solid unmelted bodies of alloying material. Metallurgical additive bodies may also be added.

In this way, the alloy properties of each individual cast ingot may be varied as required, independently of whether the ingot is a small pour cast ingot, a large pour-cast sow or an ingot cut from a direct chill cast billet. The addition of alloying materials to the metals as they are cast into ingots, whether by direct casting or by direct chill casting, enables the smelter operator to maintain pure aluminum in the holding tank from which ingots are poured and avoid the time consuming and expensive cleaning operations required to change casting one aluminum alloy to another aluminum alloy. Further, problems of degradation of the alloying agents and nonuniform distribution of the alloying agents in a relatively large melt held in the furnace are eliminated. Some holding furnaces may contain as much as 5,000 to 300,000 pounds of molten aluminum. Pouring off of the melt into ingot molds may take five or more hours and result in degradation of metallurgical additives.

The metallurgical additive bodies described herein normally have a density greater than that of aluminum and, accordingly, sink of their own weight into the molten aluminum during casting. Proper submergence of the bodies into the aluminum prevents oxidation. When it is desirable to inoculate ingots with metallurgical additive body or bodies of alloying material which have a density less than the density of the molten metal, a weight may be attached to the bodies to form a bundle having a specific gravity greater than the specific gravity of the aluminum and assure that the bundle sinks into the molten metal and the body or bodies are submerged. The weight melts and is distributed throughout the metal upon remelting of the ingot.

As described, the invention is used to inoculate cast aluminum ingots with solid, unmelted metallurgical additive bodies or solid bodies of alloying material in order to assure that these bodies are uniformly and freshly distributed throughout the aluminum during remelting and prior to casting. The invention may also be used to place solid body additives or alloying agents in cast ingots of other metals including, iron, non-ferrous metals, (copper, lead, tin, zinc, etc.) and precious metals (gold, silver, and platinum).

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. The method of casting a useful article, comprising the steps of:

a) forming a first bath of molten metal from refined metal, scrap metal or a mixture of refined and scrap metal at a smelter;

b) flowing molten metal from the first bath of molten metal into one or more molds;

c) submerging one or more bodies of unmelted solid alloy or metallurgical additive material having a melting temperature greater than the temperature of the molten metal in each mold so that the molten metal surrounds and contacts the bodies but does not melt the bodies, said bodies alone having an amount of alloying or additive material sufficient, when melted at a smelter and distributed throughout the remelted metal in the ingots to provide a desired fresh concentration of alloying or additive material throughout the melted metal;

d) cooling and solidifying the molten metal in each mold to form one or more integral composite metal ingots including the unmelted bodies and solidified metal surrounding and contacting the unmelted bodies;

e) melting the ingots at a foundry including remelting the metal in the ingots and melting the alloy or metallurgical additive bodies in the ingots to form a second molten bath from the melted ingots only;

f) mixing the melted alloy or metallurgical additive material throughout the melted metal in the second molten bath so that such bath includes freshly distributed alloying or metallurgical additive material at a known concentration from the melted bodies only; and g) pouring molten metal from the second bath into a mold to cast a useful article.

2. The method of claim 1 including the step of gravity submerging one or more bodies in the molten metal in each mold before solidifying the molten metal.

3. The method of claim 1 including the step of casting the ingots in open ingot molds.

4. The method of claim 1 including the step of direct chill casting the ingots.

5. The method of claim 1 including the steps of forming the first molten bath from aluminum and heating the aluminum to a temperature of approximately 1,200 to 1,850 degrees Fahrenheit.

6. The method of claim 5 including the step of forming the one or more bodies from material including titanium.

7. The method of claim 6 including the step of submerging the bodies in the molten aluminum so that the molten aluminum completely surrounds and contacts the bodies before cooling and solidifying the aluminum.

8. The method of claim 1 including the steps of forming the first bath of molten aluminum and forming the bodies from material including one or more of the elements: antimony, beryllium, boron, calcium, chrome, copper, iron, magnesium, manganese, nickel, phosphorous, silicon, silver, sodium, strontium, tin, titanium, vanadium, zinc, and zirconium.

9. The method of claim 1 including the step of forming the first molten bath from non-ferrous metal.

10. The method of claim 5 including the step of providing one or more of the following alloy or metallurgical additives constituents in the bodies: antimony, beryllium, boron, calcium, chrome, copper, iron, magnesium, manganese, nickel, phosphorous, silicon, silver, sodium, strontium, tin, titanium, vanadium, zinc, and zirconium.

11. The method of casting a useful metal article with alloy or metallurgical additive material of known concentration distributed throughout the article, comprising the steps of:

a) forming a first molten metal bath;

b) pouring molten metal from the first bath into a mold, submerging an amount of unmelted alloy or metallurgical additive material in the molten metal in the mold and then solidifying the molten metal in the mold to form a composite ingot;

c) forming a second molten metal bath by melting one or more entire composite ingots, said bath including only melted metal from the ingots and alloy or metallurgical additive material from the ingots; and d) flowing molten metal from the second bath into a mold to form a useful article.

12. The method of claim 11 including the step of pouring metal from the first bath into an ingot mold, placing the alloy or metallurgical additive material into the molten metal in the mold so that the metal surrounds and contacts the material and solidifying the metal in the mold to form the ingot.

13. The method of claim 11 including direct chill casting metal from the first molten bath to form the ingot.

14. The method of claim 11 and including the step of providing a degradable constituent in the material and pouring metal from the second bath into the mold before degradation of the constituent.

15. The method of claim 11 including the step of:

g) forming the molten bath from non-ferrous metal.

16. The method of claim 11 including the step of:

g) forming the molten bath from aluminum and heating the aluminum to a temperature of approximately 1,200 to 1,850 degrees Fahrenheit.

17. The method of claim 16 including the step of:

h) providing titanium in the material.

18. The method of claim 16 including the step of:

h) providing one or more of the following elements in the material: antimony, beryllium, boron, calcium, chrome, copper, iron, magnesium, manganese, nickel, phosphorous, silicon, silver, sodium, strontium, tin, titanium, vanadium, zinc, and zirconium.

19. The method of molding a useful article, including the steps of:

a) forming a first bath of molten metal from refined metal, scrap metal or a mixture of refined and scrap metal at a smelter;

b) flowing molten metal from the first bath of molten metal into one or more molds;

c) submerging one or more bodies of unmelted solid alloy or metallurgical additive material having a melting temperature greater than the temperature of the molten metal in each mold so that the molten metal surrounds and contacts the bodies but does not melt the bodies, said bodies alone having an amount of alloying or additive material sufficient, when melted at a smelter and distributed throughout the remelted metal in the ingots to provide a desired fresh concentration of alloying or additive material throughout the melted metal;

d) cooling and solidifying the molten metal in each mold to form one or more integral composite metal ingots including the unmelted bodies and solidified metal surrounding and contacting the unmelted bodies;

e) removing the integral composite ingots from the one or more molds;

f) transporting the composite ingots from the smelter to a foundry;

g) melting the entire composite ingots at the foundry and mixing the remelted ingot metal and the melted alloy or metallurgical additive material from the bodies to form a second molten bath from the ingots only; and h) flowing metal from the second molten metal bath into a mold to form a useful article having a predetermined alloy or metallurgical additive content.

20. The method of casting a useful article, comprising the steps of:

a) forming a molten metal first melt from refined metal, scrap metal or a mixture of refined metal and scrap metal substantially free of alloy or metallurgical additive material;

b) flowing molten metal from the melt into a plurality of molds or through a continuous casting mold to form a plurality of ingots;

c) submerging one or more unmelted solid alloy or metallurgical additive bodies in each ingot while the metal in the ingot is molten, with the bodies forming a minor portion of each ingot metal; and d) cooling and solidifying the metal in the ingots without melting the alloy or metallurgical additive bodies in the ingots to form a plurality of solid composite ingots each having a major metal portion and a minor portion comprising the unmelted bodies with the alloy or metallurgical additive bodies alone providing a desired concentration of alloy or metallurgical additive material for distribution throughout the metal in the ingot upon remelting of such metal and melting of the bodies;

e) melting the ingots at a foundry including remelting the metal in the ingots and melting the alloy or metallurgical additive bodies in the ingots to form a second melt from the melted ingots only;

f) mixing the melted alloy or metallurgical additive material throughout the melted metal in the second melt so that such melt includes freshly distributed alloying or metallurgical additive material at a known concentration from the melted bodies only; and g) pouring molten metal from the second melt into a mold to cast a useful article.

21. The method of claim 20 including the step of:

e) maintaining the metallurgical composition of the first melt substantially the same during step b).

22. The method of claim 21 including the step of:

f) forming the molten metal melt from a non-ferrous metal.

23. The method of claim 22 including the step of:

g) forming the metal melt from aluminum.

24. The method of claim 23 including the step of:

h) providing titanium in said bodies.

25. The method of claim 23 including the step of:

h) providing at least one of the following elements in said bodies: antimony, beryllium, boron, calcium, chrome, copper, iron, magnesium, manganese, nickel, phosphorous, silicon, silver, sodium, strontium, tin, titanium, vanadium, zinc, and zirconium.

26. The method of claim 23 including the step of:

h) pouring molten metal from the first melt into a plurality of ingot molds.

27. The method of claim 23 including the step of:

h) flowing metal from the first melt through a direct chill mold.

28. The method of casting a useful article, including the steps of:

a) forming a first bath of molten metal from refined metal, scrap metal or a mixture of refined and scrap metal at a smelter;

b) flowing molten metal from the first bath of molten metal into one or more molds;

c) submerging one or more bodies of unmelted solid alloy or metallurgical additive material having a melting temperature greater than the temperature of the molten metal in each mold so that the molten metal surrounds and contacts the bodies but does not melt the bodies, said bodies alone having an amount of alloying or additive material sufficient, when melted at a smelter and distributed throughout the remelted metal in the ingots to provide a desired fresh concentration of alloying or additive material throughout the melted metal;

d) cooling and solidifying the molten metal in each mold to form one or more integral composite metal ingots including the unmelted bodies and solidified metal surrounding and contacting the unmelted bodies;

e) melting one or more composite ingots made in accordance with steps a) through d) only to form a second bath of molten ingot metal and molten alloy or metallurgical additive material contained in the ingots only;

f) mixing the molten metal and the molten alloy or metallurgical additive material in the second bath to distribute the alloy or metallurgical additive material from the melted bodies only throughout the molten metal; and g) casting a useful article from the second bath.

* * * * *